US006188141B1

(12) United States Patent
Daviaud

(10) Patent No.: US 6,188,141 B1
(45) Date of Patent: Feb. 13, 2001

(54) DEVICE FOR CONTROLLING ACCESS TO A SPACE CLOSED BY A DOOR

(75) Inventor: Yves Daviaud, Tournefeuille (FR)

(73) Assignee: Siemens Automotive S.A., Toulouse-Cedex (FR)

( * ) Notice: Under 35 U.S.C. 154(b), the term of this patent shall be extended for 0 days.

(21) Appl. No.: 09/230,927

(22) PCT Filed: Jul. 16, 1997

(86) PCT No.: PCT/EP97/03813

§ 371 Date: Feb. 1, 1999

§ 102(e) Date: Feb. 1, 1999

(87) PCT Pub. No.: WO98/04799

PCT Pub. Date: Feb. 5, 1998

(30) Foreign Application Priority Data

Jul. 30, 1996 (FR) ..... 96 09589

(51) Int. Cl.[7] ..... E05B 47/00

(52) U.S. Cl. ..... 307/10.5; 70/256; 70/257; 180/287; 340/425.5

(58) Field of Search ..... 307/10.1, 10.5, 307/10.4; 340/825.31, 425.5, 426; 180/287; 70/257, 256, 237; 292/336.7

(56) References Cited

U.S. PATENT DOCUMENTS 4,354,189 * 10/1982 Lemelson ..... 340/825.31
4,993,627 * 2/1991 Phelan et al. ..... 307/10.5
5,616,966 * 4/1997 Fischer et al. ..... 307/10.5
5,697,236 * 12/1997 Kleefeldt et al. ..... 70/257
5,708,307 * 1/1998 Iijima et al. ..... 307/10.5

FOREIGN PATENT DOCUMENTS

0218251A1 4/1987 (EP) .
0589158A1 3/1994 (EP) .
2733783 11/1996 (FR) .

* cited by examiner

*Primary Examiner*—Albert W. Paladini
(74) *Attorney, Agent, or Firm*—Herbert L. Lerner; Laurence A. Greenberg; Werner H. Stemer

(57) ABSTRACT

The device comprises electronic means (2, 3) for querying a transmitter-receiver circuit (1) carried by a person wishing to open the said door, for recognising a predetermined code sent in reply by the said circuit and for subsequently commanding the removal of a locking pin (10) from a catch (11) of a door latch (8) forming part of the lock, and means for the activating of the electronic means (2, 3) by the said person. The said activating means (13) are designed for operating a dialogue between the said electronic means (2, 3) and the circuit (1) and the optional unlocking of the door latch (8) of the lock before the said person's action on the handle (6) causes the door to be blocked by the friction of the pin (10) in the said catch (11) of the door striker (8).

5 Claims, 1 Drawing Sheet

DEVICE FOR CONTROLLING ACCESS TO A SPACE CLOSED BY A DOOR

BACKGROUND OF THE INVENTION

FIELD OF THE INVENTION

The present invention relates to a device for controlling access to a space closed by a door, such as a motor vehicle cabin for example and, more specifically, to such a device comprising electronic means for interrogating an emitter/receiver circuit worn or carried by a person wishing to open said door, to recognize a predetermined code emitted in response by said circuit and to then cause a locking pin to be withdrawn from a notch in a bolt that forms part of the door lock, and means by which said person can activate said electronic means.

Depicted diagrammatically in FIG. 1 of the appended drawing is a known device, for controlling access to a motor vehicle, which works by the recognition of a code emitted by a badge 1 worn by a person wishing to enter the vehicle. The badge 1 has an electronic circuit for emitting this code, but this emission is not permanent, in order to save the electric battery that powers the circuit. The circuit is activated on reception of a signal emitted by the antenna 2 of electronic means 3 comprising a computer, which means are placed in the vehicle and are capable of recognizing the code emitted in return by the badge 1 so as to allow or deny the person in question access to the vehicle. These electronic means 3 are themselves activated by this person, by pressing the button of a switch 4 placed on the door 5 of the vehicle, near to a handle such as a lever handle 6 for opening this door, this handle being articulated to this door at 6.

This button has the drawback of being visible and it may therefore be desirable to conceal it within the bodywork, it then being actuated via the lever handle 6. This handle makes it possible, via a linkage 7 depicted very diagrammatically in the figure, to withdraw a bolt 8 from a keeper 9 to allow the door 5 to be opened, as long as a pin 10 that immobilizes the bolt 8 is disengaged from a notch 11 formed in this bolt. Obviously, it is the electronic means 3 which cause this disengagement, with the aid of an electromagnet 12, for example, when the code emitted by the badge is such that the person wearing this badge is authorized to enter the vehicle.

The following difficulty is encountered when provision is made for the actuation of the switch 4 to be mechanically coupled to the actuation of the lever handle 6 for opening the door: a pulling action exerted on the lever handle 6 by a person who wants to get into the vehicle has the effect of bringing the pin 10 into abutment against a flank of the notch 11, creating substantial friction between these two parts. If then the means 3, having recognized and accepted the code emitted by the badge 1, energize the electromagnet 12 to disengage the pin 10 from the bolt 8 and thus allow the door 5 to be opened, this friction may prevent the disengagement of the pin and the door then remains closed. In order to overcome this, the person may then release his pulling action on the lever handle 6 so as to reduce the bolt/pin friction and allow these two components to disengage. This additional maneuver is, however, an irksome task which it is desirable to eliminate.

SUMMARY OF THE INVENTION

The object of the present invention is precisely to provide a device for controlling access, particularly to a motor vehicle, which, while not resorting to the presence of a visible switch button on the bodywork near to a door handle, ensures that the pin is disengaged in the event of recognition and acceptance of the code emitted by the badge, before a pulling force exerted manually on the lever handle 6 can create an amount of friction between this pin and the lock bolt that cannot be overcome by the means used for disengaging the pin.

This object of the invention, together with others which will become clear from reading the description which will follow, are achieved with a device of the type described in the preamble of this description, noteworthy in that the means of activating the electronic means are designed to allow there to be a dialog between said electronic means and the circuit worn or carried by the person, and to allow any unlocking of the lock bolt to occur before the action exerted by said person on said handle causes the pin to become stuck by friction in said notch of the lock bolt.

Other features and advantages of the present invention will become clear from reading the description which will follow and from examining the appended drawing in which:

DESCRIPTION OF THE PREFERRED EMBODIMENT

Figure 1:
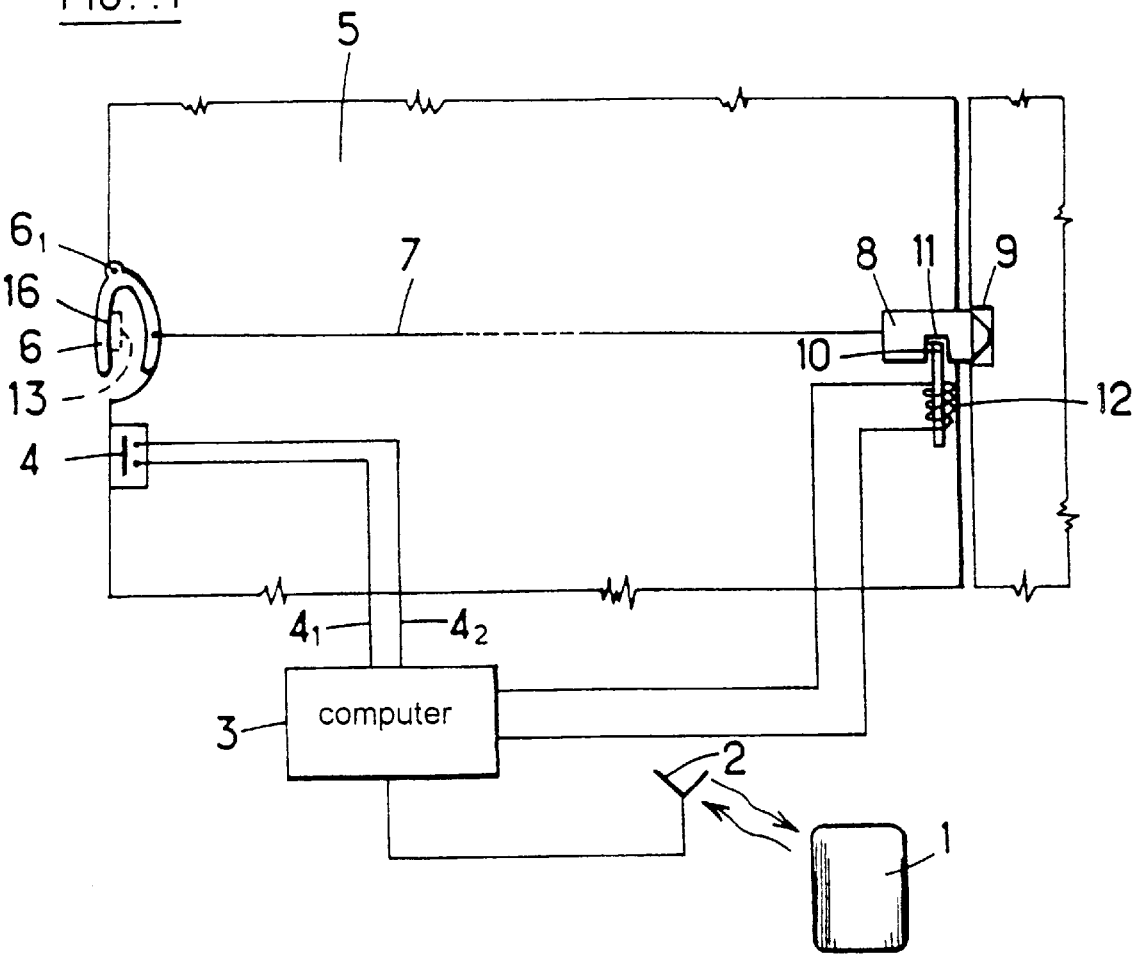
PRIOR ART FIG. :1
FIG. 1 is a diagrammatic depiction of an access-control device of the prior art described in the preamble of this description, of the type improved by the present invention.
Figure 2:
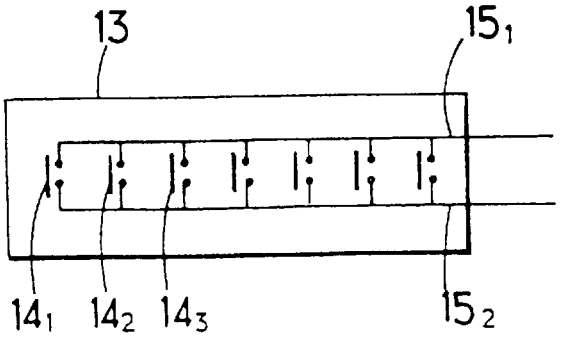
FIG. 2 is a diagrammatic depiction of one embodiment of the activating means incorporated into the device according to the invention, these means being designed to take the place of the switch button 4 of the device of FIG. 1.

So, according to the present invention, the switch button 4 of the device of FIG. 1 is replaced by activating means which, in the embodiment depicted diagrammatically in FIG. 2, take the form of an array 13 of switches 141 electrically connected in parallel between two conductors 151, 152. Advantageously, these switches are of the type which are incorporated into so-called "flexible" keypads of calculators or other computer-type machines. It is known that these switches are therefore formed of tracks of conductive ink screen-printed onto two flexible backing sheets that face each other, according to the design depicted in FIG. 2, for example, a switch being closed by local pressure on the two sheets, using a finger.

According to the invention, the array 13 is arranged on the internal face 16 of the door lever handle 6 (see FIG. 1) and the conductors or tracks 151 and 152 are connected to the electronic means 3 in place of the conducters 41, 42 associated with the switch button 4 of the device of FIG. 1.

In this position, the array 13 remains invisible from outside the vehicle, in accordance with one of the objectives of the invention. The presence of a number of switches 141, aligned horizontally for example, ensures that at least one of the switches will close when the lever handle 6 is grasped, irrespective of the positions of the fingers of the hand on the array. Finally, and above all, the almost instant closure, under very slight pressure, of one of the switches of the array 13 of the flexible keypad type ensures that the dialog between the computer 3 and the badge 1, which dialog precedes the disengagement of the pin 10 when the code emitted by the badge is recognized by the computer 3, takes place in full before the pulling force exerted by the hand on the lever handle 6 has brought the bolt 8 into abutment against the pin 10 (in the time of about 100 ms) and created so much friction between this bolt and this pin that the electromagnet 12 cannot disengage the pin from the bolt.

Of course, the invention is not restricted to the embodiment described and depicted, which has been given merely by way of example. Thus, the switches of the array of FIG. 2 may be replaced by other means capable of initiating the computer/badge dialog just as swiftly, such as capacitive-effect switches or an infrared radiation detector, etc, etc. It would also be possible to establish sufficient delay in the creation of pin/bolt friction at the time of disengagement of the bolt, using purely mechanical means, such as a spring that would stiffen the maneuvering of the lever handle so as to cause it to pivot more slowly, or by establishing an initial dead travel in the linkage connecting the lever handle to the bolt 8.

Finally, although the invention is more specifically intended to equip motor vehicle doors, it is clear that it has applications wherever access to a space is to be reserved for authorized persons: industrial or commercial premises, banks, etc.

What is claimed is:

1. In an access control system controlling access to a space closed by a door equipped with a lock and a handle for operating a lock bolt of the lock, the lock including a locking pin engaging a notch formed in the lock bolt, an access control device comprising:

an electronic device for interrogating an emitter/receiver circuit carried by a person wishing to open the door and, upon recognizing a predetermined code emitted by said circuit, for causing the locking pin to be withdrawn from the notch in the lock bolt;

an activating switch, connected to said electronic device, enabling the person to trigger a dialog between the electronic device and the circuit and, upon recognizing the predetermined code, causing a withdrawal of the pin from the notch in the lock bolt before a force exerted on the handle causes the pin to become stuck by friction in the notch of the lock bolt, said activating switch including at least one switch disposed on a surface of the handle such that said switch is triggered when the person's hand comes into contact with the handle, and wherein a time period from the triggering of the switch to an unlocking of the bolt is less than a time period starting from an instant when the handle is touched to an instant when enough friction has been created to render the pin stuck in the notch of the bolt as a result of the force exerted on the handle.

2. The device according to claim 1, wherein said activating switch includes a plurality of mutually aligned switches electrically connected in parallel.

3. The device according to claim 1, wherein said switch is an electrical switch selected from the group consisting of a flexible keypad switch and a capacitive-effect switch.

4. The device according to claim 1, wherein said activating switch is disposed on the handle so as to be substantially invisible from outside.

5. In combination, a motor vehicle and the access-control system according to claim 1, wherein the door is a door of the motor vehicle and the lock is a motor vehicle access lock.

* * * * *